US005264837A

United States Patent [19]

Buehler

[11] Patent Number: 5,264,837

[45] Date of Patent: Nov. 23, 1993

[54] VIDEO INSERTION PROCESSING SYSTEM

[75] Inventor: Michael J. Buehler, Manassas, Va.

[73] Assignee: International Business Machines Corporation, Armonk, N.Y.

[21] Appl. No.: 786,238

[22] Filed: Oct. 31, 1991

[51] Int. Cl.[5] ..... G09G 5/00

[52] U.S. Cl. ..... 345/115; 395/153; 345/189; 345/201

[58] Field of Search ..... 340/721, 723, 747, 750, 340/798, 799; 395/153, 154; 358/183

[56] References Cited

U.S. PATENT DOCUMENTS

| | | | |
|---|---|---|---|
| 4,317,114 | 2/1982 | Walker | 340/747 |
| 4,439,760 | 3/1984 | Fleming | 340/747 |
| 4,616,336 | 10/1986 | Robertson et al. | 364/900 |
| 4,947,257 | 8/1990 | Fernandez et al. | 340/723 |

OTHER PUBLICATIONS

IBM TDB article entitled "Creating an Image Stream For Network Image Processors From Coordinate Data", vol. 30, NO. 11, Apr. 1988.

IBM TDB article entitled "Programmable Video Merging" vol. 34, No. 2, Jul. 1991.

*Primary Examiner*—Richard Hjerpe

*Attorney, Agent, or Firm*—Lauren C. Bruzzone; Jesse L. Abzug

[57] ABSTRACT

The Video Insertion Processing System (VIPS) architecture provides the system architect with a modular and parallel approach to graphic processing. Using a core set of graphic modules, a wide range of graphic processing requirements can be satisfied. By providing the capability to support independent graphic paths, the performance can increase by N times for each set of graphic paths added. The use of independent graphic paths also increases the systems capability to meet real time response requirements. The key to the VIPS architecture is the ability to merge images from multiple frame buffers into a single display image. The final image is a result of selecting each pixel source based on the pixel's priority. This provides the graphics system with the capability of image overlay, underlay, merge and hide regardless of shape or size. A parallel pipelined approach provides the VIPS architecture with the capability of merging multiple images generated from the different graphic paths on a pixel by pixel basis without degradation of overall system performance.

7 Claims, 6 Drawing Sheets

VIDEO INSERTION PROCESSING SYSTEM

BACKGROUND OF THE INVENTION

Field of the Invention

This invention relates to an architecture and method for the processing, generation and merging of multiple images based on multiple independent sources of information.

In particular, an architecture and method which provides for parallel processing paths to support independent processing of multiple image generations is disclosed. The invention further provides an architecture and method which enables the merge of these multiple resultant images on a pixel by pixel basis without affecting or degrading the performance of the parallel processing paths.

Background Information

One area of computer technology which has become of significant interest due to increased processing power for decreasing cost is the area of multimedia. Multimedia involves the coordinated display of graphical and/or textual images from a variety of sources on a display. These sources could include full motion live video, external RGB video source from another graphic sub-system, information databases which may contain such items as contour maps or medical image information, or a front-end processing sub-system which may provide sonar or radar information. The information received from each source could be used to create a single image or multiple images. The information received from each source may require different levels of processing before being displayed.

One of the problems with the generation and processing of multiple images from different sources, is that there is no well defined method or architecture in place. Often the generation and processing of the multiple sources may have performance requirements which cannot be supported by a single processing path. For example, the real time requirements for both full motion video and the updates for a sonar display may not be achievable by a single processing path. Since many display images, such as sonar displays, are integrated over time, they require continuous processing. This implies that the sonar display may not be displayed, but it still requires the same amount of processing.

In addition, there is no well defined method or architecture in place to define how these multiple generated images should be merged into a single display image. Typically, these images are displayed either sequentially, allocated to different portions of the screen, or in some cases they may overlap each other. If the images overlap, they are usually restricted to rectangular areas, usually referred to as "windows". In most of these cases, the complexity of the merger of the multiple images directly affects the overall graphic performance of the system.

It is therefore desirable to provide an architecture and method for processing and displaying multiple graphic images independently and simultaneously. It is also desirable to have a method for deciding which pixels of a video image get displayed when more than one image is presented.

OBJECTS OF THE INVENTION

Is therefore an object of this invention to provide an architecture and method for processing, generating and merging multiple images.

It is further object of this invention to provide an architecture and method for merging images on a pixel by pixel basis without affecting system performance.

It is still another object of this invention to provide an architecture and method for processing graphic images in parallel processing paths.

SUMMARY OF THE INVENTION

These objects, and other features to become apparent, are achieved by the Video Insertion Processing System (VIPS) architecture which provides a modular and parallel approach to graphic processing. Using a core set of graphic modules, a wide range of graphic processing requirements can be satisfied. By providing the capability to support independent graphic paths, the performance can increase by N times for each set of graphic paths added. The use of independent graphic paths also increases the systems capability to meet real time response requirements. The modular nature of the architecture permits easy enhancement as required.

The key to the VIPS architecture is the ability to merge images from multiple frame buffers into a single display image. The final image is a result of selecting each pixel source based on the pixel's priority. This provides the graphics system with the capability of image overlay, underlay, merge and hide regardless of shape or size. A parallel pipelined approach provides the VIPS architecture with the capability of merging multiple images generated from different graphic paths on a pixel by pixel basis without degradation of overall system performance.

DESCRIPTION OF THE PREFERRED EMBODIMENT

The preferred embodiment of the invention is incorporated into a computer system which utilizes the industry standard VME and VSB buses. It is beyond the scope of this invention to describe the VME and VSB buses, and additional information can be obtained from the following publications: *The VMEbus Specification Manual,* Revision C.1, October 1985, and *VSB Specification Manual,* Revision C, November 1986, both available from Motorola Corporation. A primary function of the VME and VSB is to provide high speed data transfer buses which can be used for intersystem communication.

Figure 1:
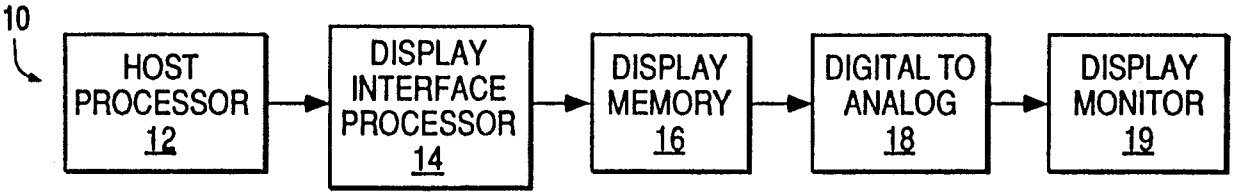
FIG. 1 is a block diagram of a typical graphical display system.

A typical graphics processing system is indicated in the block diagram shown in FIG. 1. A graphic system 10 is usually broken down into four individual sections, represented by functional blocks 12, 14, 16 and 18. The Host Processor 12 is responsible for issuing graphic commands to the display generation path, which includes blocks 14, 16, 18 and 19. The level at which the graphical commands will be issued to the display generation path is application dependent. The graphical commands issued may exist in a commonly known high order display language, such as GKS, PHIGS, or basic graphic primitives. The Host Processor 12 controls the overall graphic flow of the system. Depending on loading and system requirements, a single Host Processor 12 may handle multiple applications, or multiple Host Processors may exist, with each handling a single application. In the preferred embodiment, the Host Processor 12 is a CPU-3A processor, commercially available from Radstone Technologies.

The Display Interface Processor 14 is responsible for the interface between the Host Processor 12 and the display generation path. It also may be responsible for handling commands for one or more applications in the display generation path. Display Interface Processor 14 interprets graphic commands from the Host Processor 12. In response to these commands, it performs both general purpose and image directed computations. From these computations, the Display Interface Processor 14 updates and manipulates a graphical image in the Display Memory 16. It also can generate or receive video synchronization signals to maintain screen refreshes.

Figure 2:
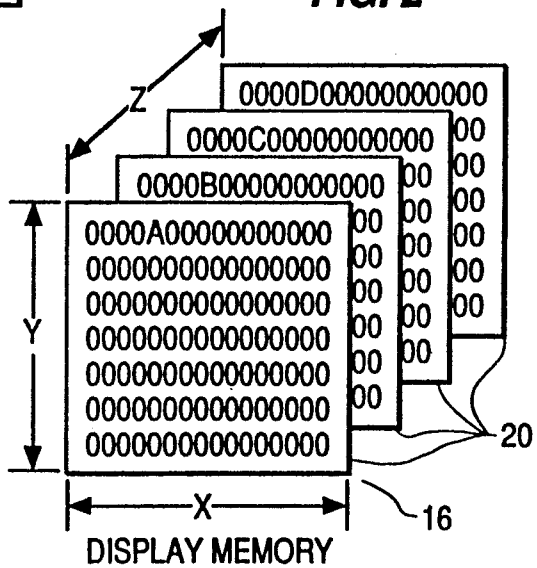
FIG. 2 is a schematic representation of the Display Memory.

The Display Memory 16 maintains a value for every pixel of a graphic image which is to be displayed on a Display Monitor 19. The range of each value maintained will depend on the depth "Z" of the Display Memory 16. The depth Z may vary between graphic systems. The depth of the Display Memory is the number of bit planes that the Display Memory supports. Each bit plane will have as a minimum the X, Y bit dimensions of the Display Monitor 19. Each bit in the bit plane will contain part of the image displayed on the Display Monitor. The value for each pixel is stored along the Z dimensions of a Display Memory 16. To access a particular X, Y pixel value, all of the bit planes will be accessed in parallel, obtaining or modifying the corresponding X, Y bit value in each plane. FIG. 2 shows a schematic representation of the Display Memory 16. In this example, there are X pixels in the X direction, Y pixels in the Y direction and Z represents the number of bit planes or depth of display memory.

Referring back to FIG. 1, the Digital to Analog Converter (DAC) 18, consists of the logic to take the digital output from the Display Memory 16 and convert these digital inputs into Red, Green and Blue analog signals which will drive the Display Monitor 19. The DAC 18 may also drive the video timing for the system.

Figure 3:
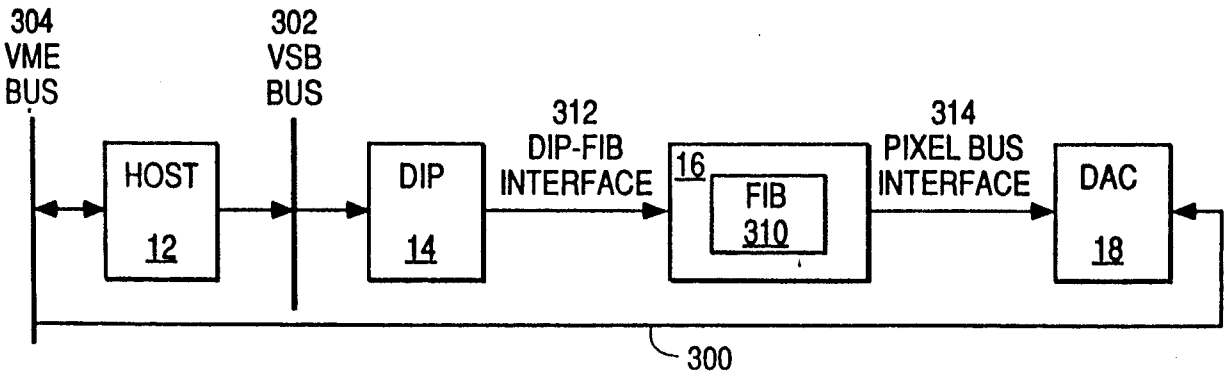
FIG. 3 is a block diagram of the basic Video Insertion Processing System.

The basic configuration for the Video Insertion Processing System is shown in FIG. 3. The Host Processor 12 is responsible for issuing graphic commands to one or more Display Interface Processors 14 in the display generation path. The interface to the display generation path is over the VSB bus 302, which provides a private bus between the Host Processor 12 and the display generation path. The traffic generated on this bus will not affect or be affected by bus traffic on the VME bus 304. The VSB bus 302 allows for multiple masters on each VSB bus. In the VIPS, the Host Processor 12 performance can be increased by either replacement with a higher performance module or the addition of additional processors in parallel.

As stated above, the Display Interface Processor 14 provides the system with a programmable graphic engine. It receives commands from the host over the VSB bus 302. The Display Interface Processor (DIP) 14 interprets, executes and responds to these host commands. From these commands, the DIP 14 will update and manipulate the digital images kept in its display memory. There may be multiple DIP modules 14 in the system depending on the system requirements. The DIP design also supports multiple display memories. Besides updating and manipulating the images in display memory, the DIP 14 also maintains external video synchronization based on the system video timing which is generated by the Digital to Analog Converter 18.

The Frame Insertion Buffer (FIB) module 310 functions as the Display Memory 16 for the display generation path of the VIPS. The number of FIB modules 310 in a system depends on the application requirements and the amount of memory provided on each FIB 310 module. The minimum requirement for the FIB 310 is to generate a value for every pixel on the Display Monitor 19 (FIG. 1).

The FIB 310 provides two interfaces. The first interface supports accesses from the DIP 14 to provide a path for the DIP module to access the FIB 310. The second interface is used to support the screen refresh of the Display Monitor 19 via the DAC 18.

The Digital to Analog Converter 18 generates the video timing for the entire system. From this timing, all elements in the display generation path involved in generating the information used during screen refresh are kept in synchronization. During screen refresh, the DAC 18 receives a stream of digital pixel data which represents the image to be displayed. The stream of digital pixel data is a result of the combinations of all of the FIBs in the system. Each pixel received will be some number of bits deep. This value must be converted into three intensity levels to be used to generate red, green and blue analog signals for the Display Monitor. This is done by passing the pixel value through a color look-up table or CLT, which is essentially three random access memories (RAM). Each of the three RAMs is dedicated to either the red, green or blue analog signals. After the intensity conversion, these values are used by the DAC to generate the analog signals. The DAC 18 communicated over the VME bus 304 so that it can be accessed by any Host Processor 12.

Figure 4:
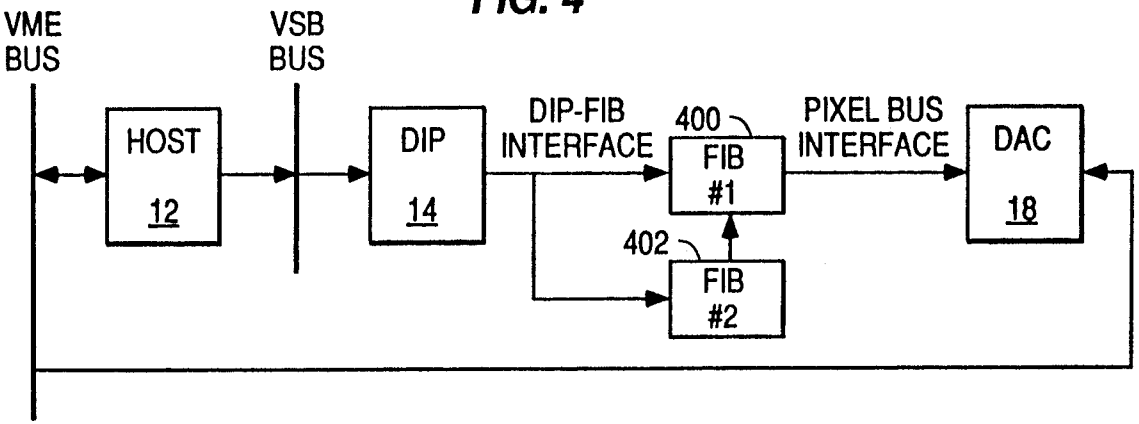
FIG. 4 is a block diagram of a double buffered VIPS implementation.

In many applications, double buffering is required to eliminate flicker. Flicker can occur when large numbers of pixel values are to be moved within the image that is being displayed at the monitor. Double buffering is also used to simulate instantaneous changes in the image at the monitor. As an example, assume a map image currently exists in FIB #1 400 in FIG. 4, and is being displayed on a monitor. The map image utilizes the full screen size of the monitor and requires the full depth of the FIB 400. The Host 12 then issues a command to scroll down the map to a new location. Due to the large amounts of data, if the DIP 14 tried to modify the image within FIB #1 400, the image on the monitor would probably appear to flicker. If the DIP 14 first builds the new map image in FIB #2 402, however, and then switched the monitor input from FIB #1 400 to FIB #2 402, the update on the monitor would appear to be instantaneous. This requires the display generation path to be able to select which FIB the DAC 18 uses in generating the image.

Figure 5:
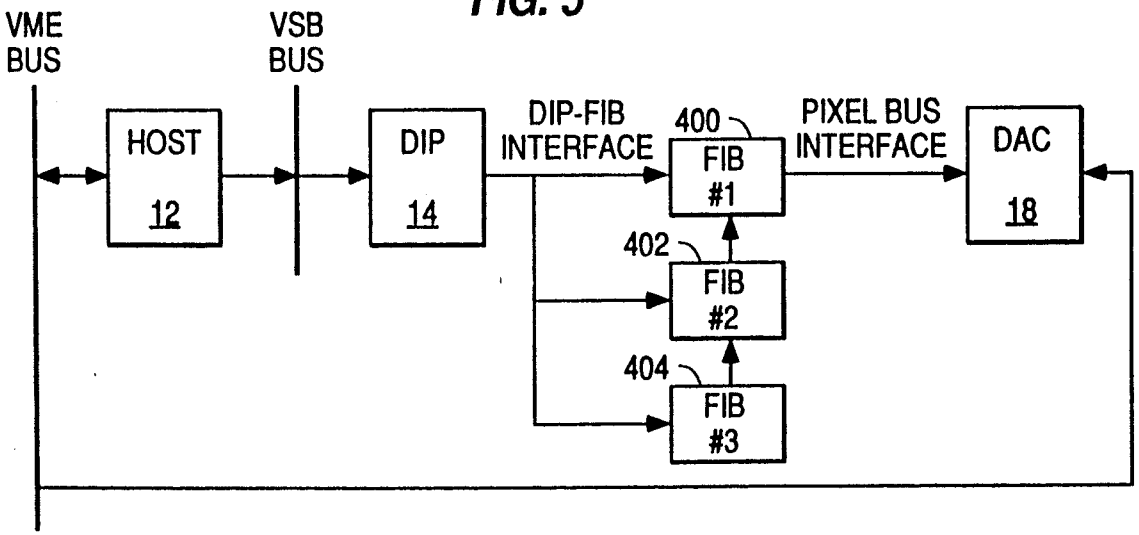
FIG. 5 is a block diagram of a double buffered VIPS implementation with overlay.

If, for example, there is a requirement to display target information on top of the map image, and the map image takes the full depth of the FIB, then another FIB module 404 would be required to maintain the target information as shown in FIG. 5. At screen refresh time, the system has to select the active map image and the target information to create a single image. Whereas the selection between map images is performed on a FIB basis, the selection between the target images and map images must be done on a pixel by pixel basis. Since the target location may be continuously updated/moved, the pixel selection between the map image or target image must occur during the screen refresh cycle. If a pixel in FIB #3 404 is equal to zero, then the corresponding pixel in the map image should be displayed. If a pixel in FIB #3 is not equal to zero, then the pixel from the target image should be displayed. As mentioned before, this application requires a merge to perform both a frame buffer selection for the map image and a pixel by pixel merge to include the target information.

The process for merging images will now be described. In some applications, a single FIB may not provide sufficient bit planes to support the desired images in a non destructive manner. When this occurs, the images must be determined on a pixel by pixel basis. In the previous example, the one FIB buffer with target information always overlayed the other FIBs which contained the map images. Overlapping and underlaying images requires that the pixel selection during the merge of the two FIB outputs be performed on a pixel by pixel basis.

In addition, the basis for pixel selection must extend beyond checking if the value of a pixel is equal to zero as in the simple overlay example described above. One method to address this is to assign a priority to each pixel value in the image. The priority value is then used to determine which pixels will be displayed on the Display Monitor. The algorithm to assign the priority values, depends on the specific application and design of the FIB module.

Figure 6:
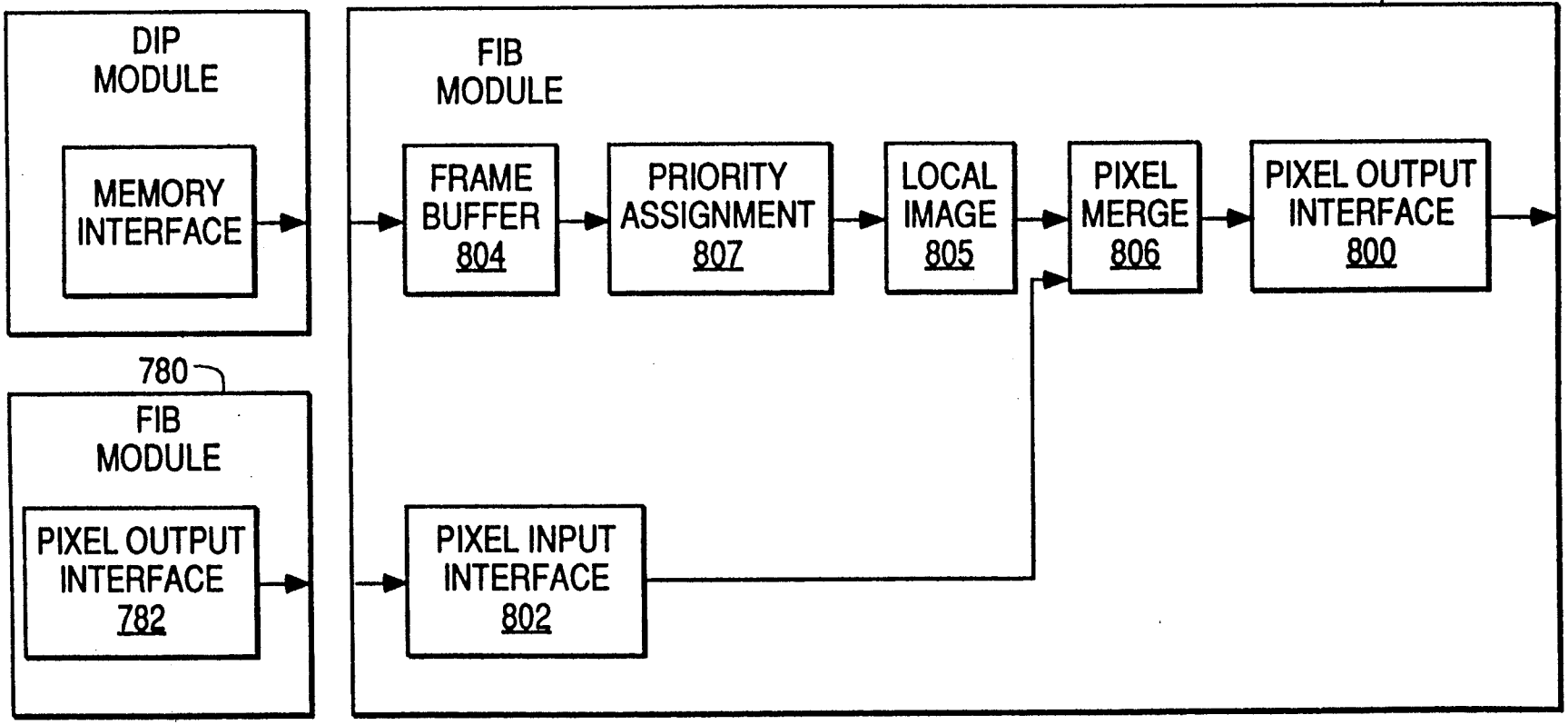
FIG. 6 is a block diagram of the Frame Insertion Buffer.

As shown in FIG. 6, each FIB module 803 includes a frame buffer 804, local image buffer 805, a pixel merge buffer 806, a priority assignment buffer 807, a pixel output interface 800 and a pixel input interface 802. During the merge sequence, the priorities of each pixel for a particular (X,Y) position for each local image will be compared. For a particular (X,Y) location, the pixel with the highest priority value could overlay all pixels with a lower priority and be displayed on the Display Monitor. If two pixels at the same (X,Y) location in two different local images 805 have the same priority, the local image that is contained on the FIB module which is closer to the DAC is displayed.

As mentioned before, at some point the local images from multiple FIB modules must be merged. As the number of FIB modules increase, the more complex the merge becomes. Clearly, the amount of I/0 and logic to perform a merge of an 8 FIB system at a single point would be objectionable. The VIPS architecture provides a unique method to merge the local images together. VIPS distributes the merge to each of the FIB modules. At each FIB module, the FIB will perform a merge between its local image 805 and an incoming external image from pixel input interface 802. The incoming external image is equivalent to the local image in height, width and depth. It also has priorities assigned to each pixel similar to the local image. The FIB will compare the priority of pixel (X,Y) from the local image 805 to the priority of pixel (X,Y) of the incoming external image in accordance with an algorithm that is application dependent. The combination of the pixels selected and their associated priorities will be combined to generate an outgoing external image which is equivalent to the local images height, width and depth. The external image is stored in pixel merge buffer 806.

Figure 7:
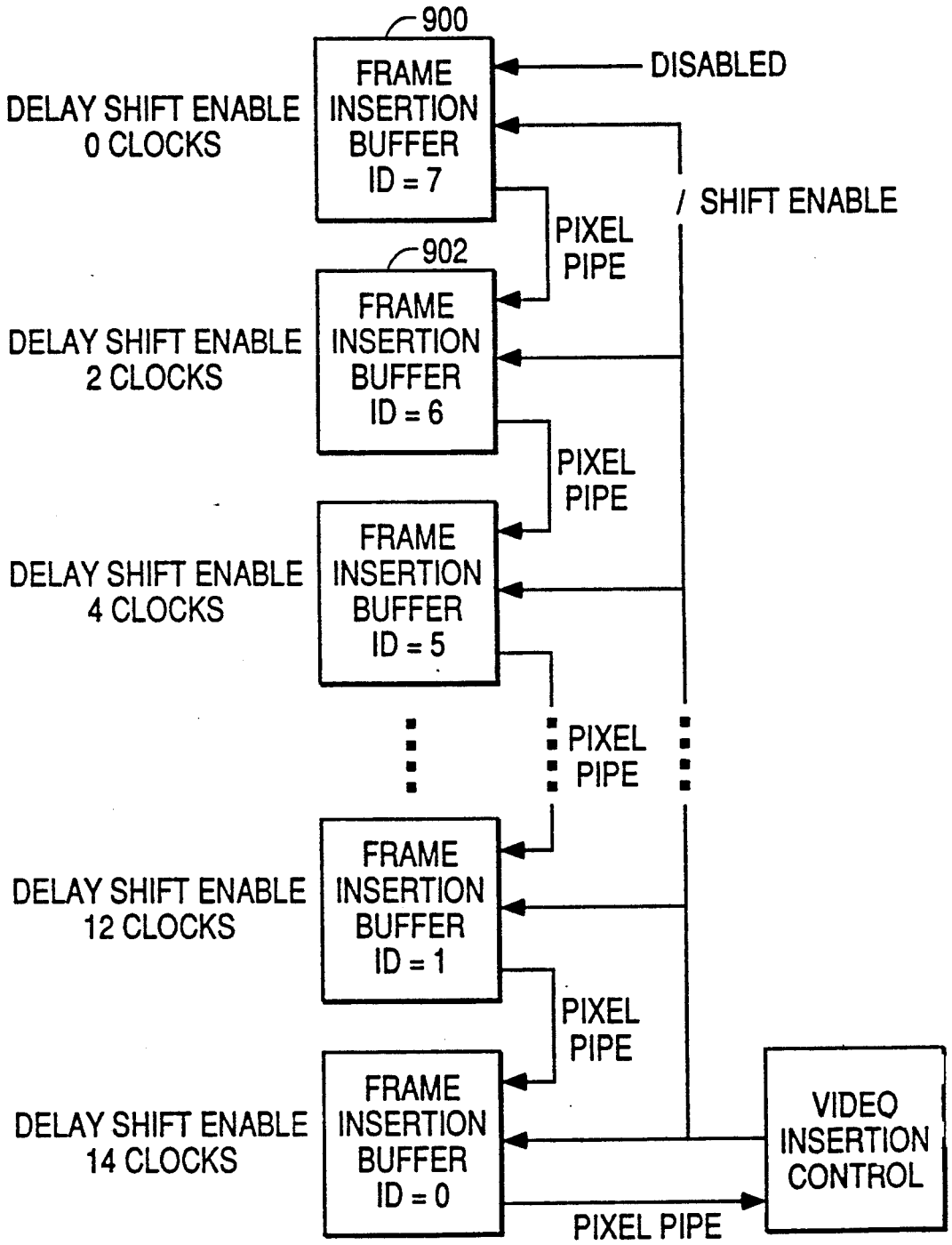
FIG. 7 is a block diagram showing the flow of the image data during a merge process.

The VIPS merge sequence will now be described with reference to FIG. 7. At the beginning of screen refresh, the FIB with the highest ID 900 begins to shift out its local image. This local image will remain intact when it is passed to the next FIB 902, since its incoming external image is disabled. The FIB 902 merges its local image with the incoming external image from the FIB 900. Assume it takes two clock cycles to transfer pixel data, i.e., the local image, from FIB 900 to FIB 902. If FIB 900 and FIB 902 begin shifting pixel data out at the same time, pixel (X,Y+2) of FIB 900 would be compared to pixel (X,Y) of FIB 902. Due to the two clock cycle delay which is incurred at each FIB to perform the compare, each FIB must delay its local image generation by a number of clock cycles. For an 8 FIB system, the delay is equal to (7-FIB ID)x2. By performing this delay, each FIB will merge pixel (X,Y) of its local image with pixel (X,Y) of the incoming external image.

As an example of one possible merge process, all pixels associated with a window image #1, which overlays window image #2, would be assigned the highest priority. If window image #2 is subsequently desired to overlay window image #1, the priority of window image #2 would be increased and the priority of window #1 would be decreased. During the screen refresh, pixels from window image #2 would be selected over pixels from window image #1. The background or unused pixels in all these images must also be assigned a priority level. These pixels should be assigned the lowest priority in the overlay scheme. This will allow all of the active pixels of the two window images to be displayed.

If for a particular application an image is to be hidden, the priority of the image could be dropped below the priority of the background images of another FIB module. This would cause the background images of another FIB module to overlay the image to be hidden.

Using the merge technique described above, the resultant screen refresh consists of a merge of the outputs of the FIB modules on a pixel by pixel basis based on a priority scheme. By assigning a priority value to each pixel in a FIB, the merge will allow images to overlay and underlay other images independent of which FIB the image is located. By allowing priority to be assigned to each individual pixel, an image can be considered to be a single cursor or line or it could be the entire frame buffer.

Many system aspects of the VIPS architecture are highly application dependent. The quantity of FIB's, the number of priority levels required and the amount of display memory used on each FIB. The amount of display memory contained on any FIB is not restricted. The FIB must, however, be able to create a local image which will support the system screen resolution parameters in height, width and pixel depth. The local image is actually the digital pixel bit stream which is generated during a screen refresh. The pixel data is shifted out of the frame buffer in M lines where M is the number of visible lines on the display monitor. Each line will consist of N columns where N is the number of visible columns on the display monitor. A pixel value must be generated for all MxN pixel locations on the display monitor. This pixel bit stream or local image as it will be referred is what would normally, in most graphic systems, go directly to the RAMDAC or D/A convertor.

In a single FIB configuration, the outgoing external image would pass directly to the DAC module 18 for D/A conversion. The incoming external image would be forced to zeros or disable. Therefore, the entire local image would be passed to the DAC module for display. If an additional FIB 780 is added to the system as shown in FIG. 6, its outgoing external image 782 would feed into the incoming external image 802 of the original FIB 803. If additional FIB's are added, they would be connected the same way. The FIB itself provides the hardware necessary to merge the FIB's local image 805 with the incoming external image and to output a resultant image to be passed to the DAC or to another FIB module. With the proper use of priorities, the location of the FIB does not restrict the position of its local image in the overlay/underlay scheme of the system.

Since the DAC controls when the local image generation occurs, i.e., shifting of the pixel data, it must be aware of the maximum number of FIBs in the system. If the DAC requires to start receiving the local image at clock cycle T, it must request generation of the local image at clock cycle T-(2MAX+2) where MAX is the maximum # of FIBs in the system. This will allow enough time for the local images to flow through each of the FIB modules. In order for the VIPS system to properly perform, it is not necessary to have populated the maximum number of FIBs possible in the system. It is required, however, that the FIB's IDs must start with the lowest and work up. For example, the maximum number of FIBs defined for a system is 8 and the populated number of FIBs is 6, the IDs for the populated FIBs should range from 0 to 5. The FIB IDs must also be continuous and cannot be segmented. This feature does allow FIBs to be added or deleted from the chain with all additions or deletions occurring at the end of the chain.

The DAC and at least a portion of all the FIBs must remain in sync. The portion of the FIB which must remain in sync with the DAC is the logic which generates the local image and merges the local image with an incoming external image. It does not, however, require that the DIP which updates and modifies the FIB's frame buffer remain synchronous with the DAC. To support both of these asynchronous requirements on the frame buffer, VRAMs are used to implement the frame buffer. The VRAMs can be considered a dual ported device. It consists of a DRAM interface and a serial data register interface. The VRAM provides a feature which allows a transfer of data between any row in the DRAM to and from the serial data register. Once the data has been transferred to the serial data register, both the DRAM interface and the serial data register interface can be accessed simultaneously and asynchronously from each other. This allows the DIP module to access the DRAM interface at the same time local image generation logic is accessing the serial data register interface.

Although the DIP processor does not have to remain in sync with the DAC, it is however, responsible for initiating the DRAM to serial data register transfer at the proper times. In order for it to perform these transfers appropriately, the DIP's graphic processor must monitor the HSYNC, VSYNC and a video clock signals which are based on the display CRT's timing. The FIB module will receive these signals from the DAC module. The FIB will delay these signals by a number of clock cycles based on the FIB modules ID as described above and pass them to the DIP module.

The final resultant image which is passed to the DAC module is a combination of all the local images from each FIB module. These pixel values defined in this final image is what is used to generate the RGB video signals passed to the Display Monitor. Therefore, in generating the local images, all FIB modules must use the same color table to convert the digital pixel values to analog signals. In other words, if FIB #1 and FIB #2 want to display red, the pixel value in the local image should be the same value for both FIBs. In many D/A converters available today, a Color Lookup Table (CLT) exists to translate pixel values into individual color intensities for the Red, Blue and Green analog signals. This allows a single translation between the final image pixel values and the actual colors viewed at the display monitor. A system which generates a local image based on 8 bit deep pixels will provide 256 unique available colors. As this 8 bit value is passed through a RAMDAC, it is translated into three 8 bit values through three individual CLTs. These three 8 bit values will drive three D/A converters to generate the red, green and blue analog signals.

Assume a FIB contains 8 bit planes in its frame buffer and 1 bit plane is used for cursor and the other 7 bit planes are used for data. If a bit is active in the cursor bit plane, the other 7 bits are essentially "don't cares". This means out of the 256 color values possible with 8 bit planes only 129 color values will be generated. This assumes a single color for the cursor independent of the other 7 bit planes and 128 colors for the data image when the cursor bit plane is inactive. Converting this pattern into actual color values could be achieved at the DAC in the RAMDAC, but it would limit the systems available colors to 129. If in a different FIB in the same system, two images are maintained in a single frame buffer each utilizing 4 bit planes and the RAMDAC is used to convert the pixel values into the actual color values, there will be a conflict in the color translation between the FIB with the cursor and data image and the FIB with the equal 4 bit images.

Other approaches can be taken which would not be as expensive as the CLT approach, but they are not as flexible or generic. For example, assume the case of the FIB which maintains both a 7 bit image and a 1 bit cursor. Since the lower 7 bits do not affect the color of the cursor, instead of passing the original 8 bits, a fixed 8 bit pattern could be forced representing the desired cursor color. This still limits that particular FIB to generating a possible 129 colors, but would allow the number of available system colors to remain at 256. This moves the color translation of this particular application from the RAMDAC to the FIB which is supporting the application.

Generation of the local image and the algorithms to assign priorities to each pixel in the local image is also highly application dependent. One method is to assign a whole window or an active image in a frame buffer one single priority. The background or unused portions of the frame buffer could be set to a different priority. The basic algorithm is if the pixel value is zero, the pixel is assigned the background priority. If the pixel value is non-zero, the pixel is assigned the frame buffer priority. This would imply, in this example, that the local image generated from a single FIB would have only two levels of priority. In most applications, this would be suitable.

Figure 8:
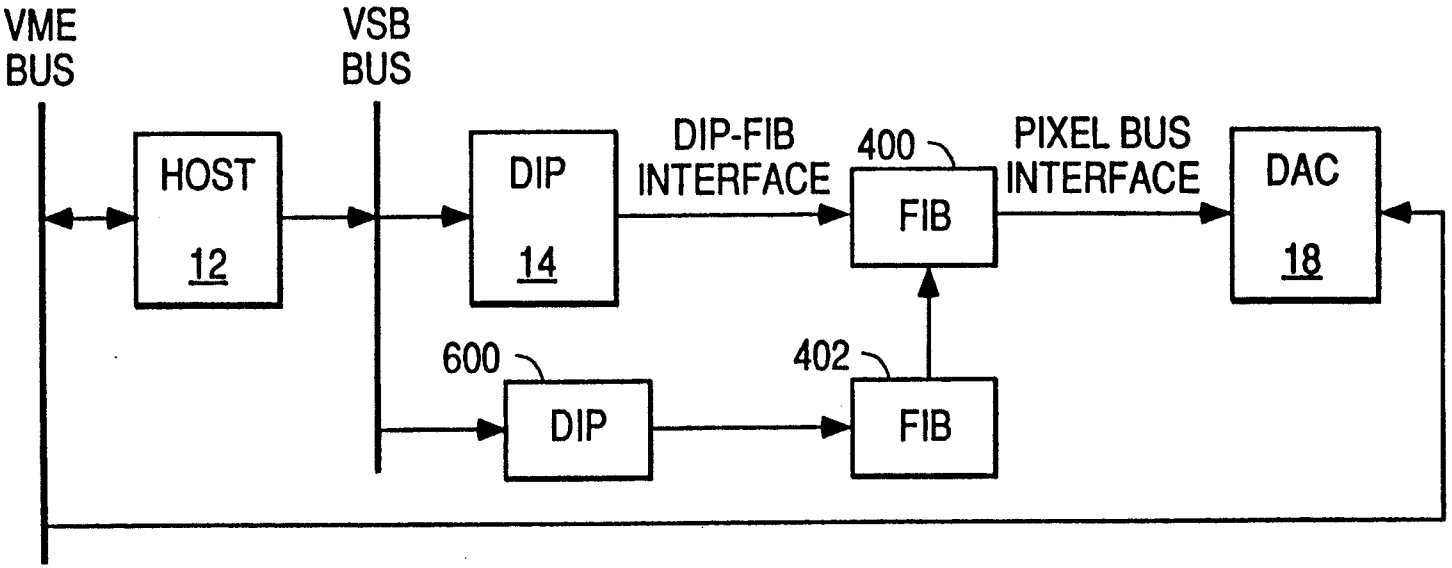
FIG. 8 is a block diagram of a dual DIP implementation.

If it is necessary to increase graphic processing power and speed, the architecture can be implemented as shown in FIG. 8 with a second Display Interface Processor 600. This would double the graphic processing performance of the system as long as the application can be partitioned for distributed processing. The merging of the two different FIB's 400 and 402 would also be handled with the priority scheme.

Figure 9:
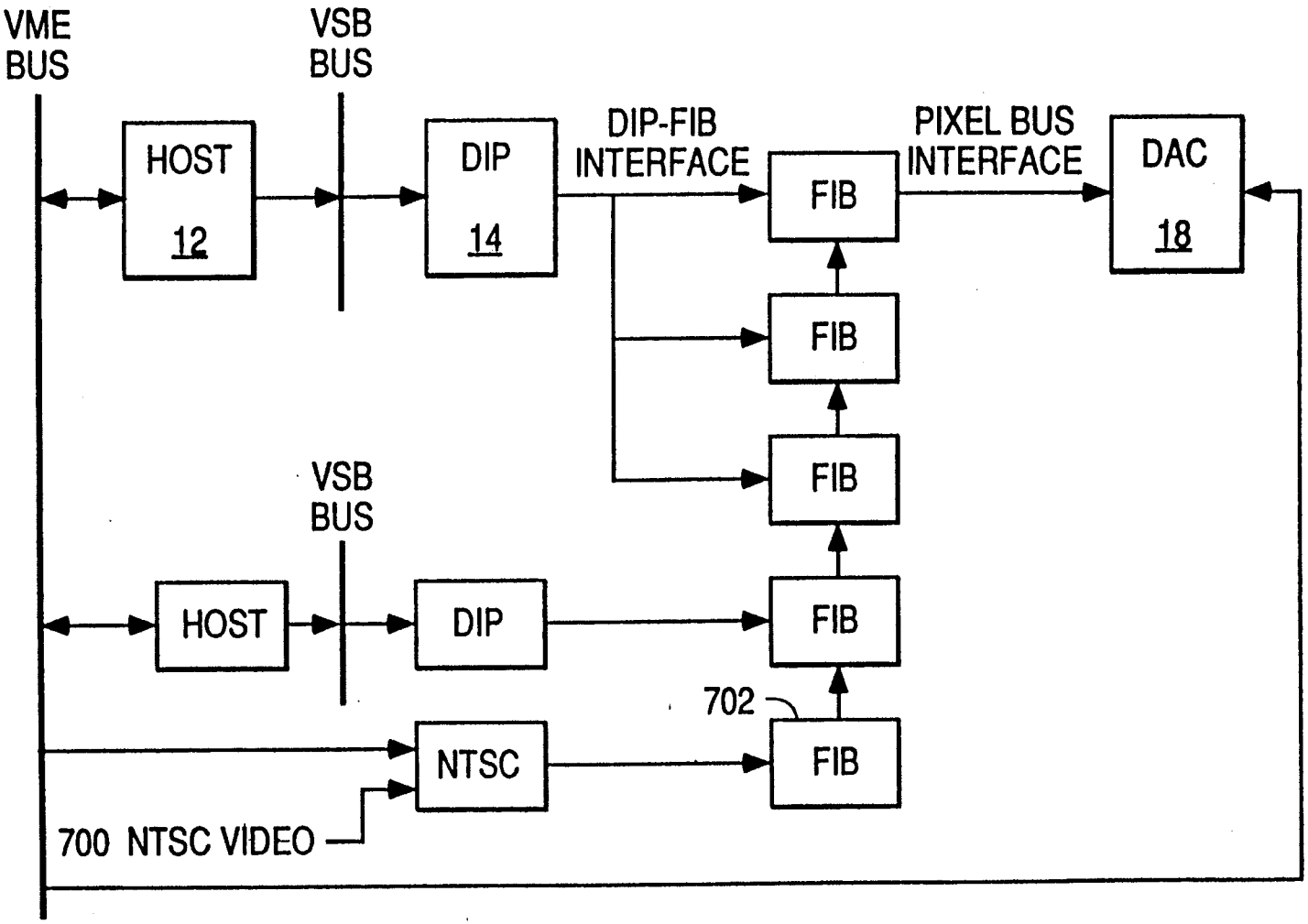
FIG. 9 is a block diagram of the VIPS including the NTSC video processing.

Another addition to the above architecture might be an NTSC (Standard Broadcast Video) to digital conversion as shown in FIG. 9. This might be used for visual contact of a particular target. The NTSC to digital conversion requires a dedicated graphical processing path to meet the real time update requirements. The digital image based on the video input 700 would be assembled in a dedicated frame buffer 702. Since the digitized image is continually being updated, without affecting or being affected by any other graphic process in the system, there is no build or assembly time required to display the digitized image. The digitized image would appear or disappear instantaneously depending on its assigned priority.

In a simulation environment, it may be desirable to maintain 256 levels in the Z dimension. For example, a tank could appear to gradually pass through a forest. The forest or landscape would appear in one frame buffer with each image in the landscape having a different priority depending on its depth position. The tank image could be maintained in another frame buffer. The tank image would vary its priority depending on relative depth location of the tank. This would imply that the FIB which maintained the landscape image could generate a local image which has pixel priorities which range from 0 to 255. The two methods above could be considered two extreme cases. There are several intermediate cases which can take advantage of VIPS's flexibility.

Another feature which is supported by the FIB modules is a Pass-Thru mode. This allows the FIB module to prevent its local image from being merged with the incoming external image. The incoming external image will pass through the FIB module without being modified. This added feature is very useful when double buffering. By using this feature, it reduces the requirements on the number of priority levels necessary for the system. It also allows an image to be hidden while the graphic processor is building an image in the frame buffer. After the image is complete, the image can instantaneously appear on the display monitor once the Pass-Thru mode is disabled.

Another advantage that the VIPS provides is a method for storing some or all of the displayed images without affecting the performance of the display generation path, sometimes referred to as a transparent hard copy (THC). The THC module would receive the same stream of digital pixel data as the DAC 18. This stream of digital data represents the actual image which is displayed on the system monitor. As the screen is refreshed, the THC can sequentially store the pixel data into memory to be read later by a Host Processor. To compensate for any translation done in the DAC CLT, the CLT can be added to the THC to be used while storing the data in to RAM on the THC. The THC would have an enable signal to capture and hold a single frame until it is reenabled again. The Host Processors can then access the THC module over the VME bus to read the image. Using a digital technique for hard copy reduces the possibilities of errors.

While the invention has been described with reference to a preferred embodiment, it will be understood by those skilled in the art that various modifications can be made without departing from the spirit and scope of the invention. The modular and flexible nature of the invention permit different configurations to meet specific requirements. Accordingly, the scope of the invention shall only be limited as set forth in the attached claims.

I claim:

1. A method for merging the data representing N images stored in N frame insertion buffers comprising the following steps:

providing N frame insertion buffers each of which generates a local image;

assigning each pixel in each local image a priority number;

passing the local image data from the Nth frame buffer to a N-1st frame buffer;

pairwise comparing the priority number assigned to each pixel of the local image data from the Nth frame buffer to the priority number assigned to each pixel of the local image data in the N-1st frame buffer on a pixel by pixel basis;

merging each pixel of the local image data from the N and N-1st frame buffers based upon a priority algorithm;

storing each pixel of the resultant merged image data in the N-1st frame buffer;

passing said merged image data in said N-1st frame buffer to a N-2nd frame buffer; and repeating sequentially the pairwise comparing, merging, storing, and passing steps until all of the data in all of the frame buffers have been merged.

2. The method as claimed in claim 1 wherein said comparing step includes a pixel by comparison of the priority of each pixel in each row and column in the frame buffer.

3. A system for receiving graphical data input from a variety of multimedia sources and merging said graphical data for display comprising:

at least one host processor;

at least one display interface processor for performing graphical processing, said host processor and display interface processor communicating over a bus;

a plurality of frame insertion buffers coupled to said display interface processor, each of said buffers being assigned a sequential number, each of said buffers being used for storing a pixel by pixel representation of graphical data;

means for pairwise merging said graphical data for each pair of said frame insertion buffers based on a priority level assigned to the pixels, said merging means comprising:

means for selecting a first of said frame buffers;

means for pairwise comparing said priority level assigned to each pixel in said first selected frame insertion buffer to said prior level assigned to each pixel in a second selected frame buffer, said assigned sequential number of said second selected frame buffer immediately preceding said sequential number of said first selected frame insertion buffer, said comparison being performed on a pixel by pixel basis;

means for merging said graphical data from said first selected frame insertion buffer and said second selected frame insertion buffer based upon a priority algorithm;

means for storing each pixel of the resultant merged graphical data in said second selected frame buffer;

means for pairwise comparing said merged graphical data to graphical data in a third selected frame buffer, said assigned sequential number of said third selected frame buffer immediately preceding said sequential number of said second selected frame insertion buffer, said comparison being performed on a pixel by pixel basis;

means for merging said merged graphical data and said graphical data from said third selected frame buffer based upon a priority algorithm, resulting in newly merged graphical data in said third selected frame buffer;

means for storing each pixel of the resultant newly merged graphical data in said third selected frame buffer; and means for repeating the pairwise comparing, merging and storing steps for each of said sequentially numbered frame buffers until all of said graphical data in all of said frame insertion buffers have been merged to provide finally merged graphical data in a lowest numbered sequential frame buffer;

means for converting said finally merged graphical data and converting said finally merged graphical data to analog signals; and display means for converting said analog signals into a displayed image.

4. A system as in claim 3 further comprising a means for receiving said graphical data from a plurality of sources.

5. A system for receiving graphical data input from a variety of multimedia sources and merging said graphical data for display comprising:

at least one host processor;

at least one display interface processor for performing graphical processing, said host processor and display interface processor communicating over a bus;

at least three frame insertion buffers, each of said buffers having associated graphical data and being used for storing a pixel by pixel representation of said graphical data; said at least three buffers comprising, a first frame insertion buffer having a first pixel value and a second pixel value, said first pixel value representing point (x1,y1) of said graphical data associated with said fist buffer and having a first priority value p1 and said second pixel value representing point (x2, y2) of said graphical data associated with said first buffer and having a second priority value p2;

a second frame insertion buffer having a third pixel value and a fourth pixel value, said third pixel value representing point (x1, y1) of said graphical data associated with said second buffer and having a third priority value p3 and said fourth pixel value representing point (x2, y2) of said graphical data associated with said second buffer and having a fourth priority value p4;

a third frame insertion buffer having a fifth pixel value and a sixth pixel value, said fifth pixel value representing point (x1, y1) of said graphical data associated with said third buffer and having a fifth priority value p5 and said sixth pixel value representing point (x2, y2) of said graphical data associated with said third buffer and having a sixth priority value p6;

a first pairwise pixel merge means having an input coupled to said first frame insertion buffer and said second frame insertion buffer, said first merge means comprising:

means for comparing said first pixel priority value p1 with said third pixel priority value p3 and selecting from said first pixel value and said third pixel value a first selected pixel value associated with the higher of p1 and p3; and means for comparing said second pixel priority value p2 with said fourth pixel priority value p4 and selecting from said second pixel value and said fourth pixel value a second selected pixel value associated with the higher of p2 and p4;

means for storing said first and second selected pixel values in said second frame insertion buffer; and a second means for pairwise pixel merge having an nut coupled to said second frame insertion buffer and said third frame insertion buffer, said second merge means comprising:

means for comparing said pixel priority value associated with said first selected pixel value with said fifth pixel priority value p5 and selecting that pixel value associated with the higher of said pixel priority value associated with said first selected pixel value and p5;

means for comparing said pixel priority value associated with said second selected pixel value with said sixth pixel priority value p6 and selecting that pixel value associated with the higher of said pixel priority value associated with said second selected pixel value and p6; and means for storing said selected pixel values from said second merge means in said third frame insertion buffer;

means for converting said selected pixel values from said storing means of said second merge means to analog signals; and display means for converting said analog signals into a displayed image.

6. A system as in claim 5 wherein said first pixel priority value p1 has the same priority as said third pixel priority value p3 and wherein said first pixel merge means compares said first pixel priority value p1 with said third pixel priority value p3 and selects the pixel whose associated frame buffer is closer to the display means.

7. A system as in claim 5 further comprising a means for receiving said graphical data from a plurality of sources.

* * * * *